United States Patent [19]

Leonard, Jr.

[11] Patent Number: 4,611,779

[45] Date of Patent: Sep. 16, 1986

[54] ADJUSTABLE OBJECT HANGER

[76] Inventor: Gustav Leonard, Jr., 4208 Braeburn Dr., Fairfax, Va. 22032

[21] Appl. No.: 679,923

[22] Filed: Dec. 10, 1984

[51] Int. Cl.[4] ..... A47G 1/24

[52] U.S. Cl. ..... 248/476; 40/621; 40/622; 248/495; 248/546

[58] Field of Search ..... 248/476, 475.1, 489, 248/490, 327, 317, 234, 546, 544; 40/618, 620, 621, 622

[56] References Cited

U.S. PATENT DOCUMENTS

| | | | |
|---|---|---|---|
| 681,380 | 8/1901 | Turner | 248/495 |
| 2,522,901 | 9/1950 | Schrager et al. | 248/495 |
| 2,546,359 | 3/1951 | Emrick | 248/234 |
| 2,697,572 | 12/1954 | Pfankuch | 248/495 |
| 2,723,096 | 11/1955 | Schwartz | 248/495 |
| 2,791,388 | 5/1957 | Hirt | 248/495 |
| 3,188,028 | 6/1965 | Waller | 248/495 X |
| 3,300,173 | 1/1967 | Kennedy | 248/546 X |
| 4,220,309 | 9/1980 | Eisen et al. | 248/546 X |

*Primary Examiner*—Ramon O. Ramirez

*Attorney, Agent, or Firm*—Lowe Price LeBlanc Becker & Shur

[57] ABSTRACT

Temporary locaters, preferably magnetic, are used to mark with high accuracy the correct positions for attaching support means to a load-bearing surface, such as a wall, at two horizontally spaced positions. An object with a substantially flat side is then supported from these positions by securely held threaded individually adjustable rods whose lower ends are bent to receive the object's weight from object hangers attached to the back of the object. One or more snubbers, preferably with resilient soft surfaces for safely contacting the adjacent wall surface, are attached to the object to obtain even spacing between the object and the wall. Initial fine adjustment and subsequent adjustment to compensate for any misalignments are obtained by individually turning threaded bushings holding up the rods.

20 Claims, 9 Drawing Figures

ADJUSTABLE OBJECT HANGER

TECHNICAL FIELD

This invention relates generally to an apparatus and a method for securely supporting a typically flat object, such as a picture, mirror, diploma or plaque or a vertical surface and, more particularly, to improvements enabling compensation for any initial or subsequent misalignment of the object with respect to the support surface.

BACKGROUND OF THE INVENTION

Pictures, mirrors and diplomas are among generally flat objects commonly hung from walls for their intended ornamental or functional purposes. It is aesthetically important to most people to have such objects positioned in harmonious alignment with the walls, corners, doorways and windows, or furniture visible in conjunction therewith.

A common technique for achieving this is to have a string or wire attached at its ends to two points on the supported object and supported at a generally central position from a nail, screw or hook affixed to the supporting wall. Vertical alignment of the object is obtained by altering the wire length and, to a lesser extent, horizontally by moving the string or wire over the nail by a short distance and utilizing friction between the lower edge of the object and the wall surface to maintain the preferred alignment. Depending on where the suspending wire is attached to the object, how long it is, and how heavy the object is, there will be a visible gap at the top between the back of the object and the adjacent wall. While an earthquake usually will cause misalignment or even the fall of the object, much the same can happen from an accidental push, a slamming door, or a sudden gust of wind from an open window. The constant and generally indiscernible vibration experienced by supporting surfaces such as walls, as a result of pedestrian and vehicular traffic or the operation of machinery, may also change the alignment of the object over time. Having two supporting nails or screws may increase the margin of safety somewhat, but the problems remain.

U.S. Pat. No. 2,791,388, to Hirt, teaches the use of a wall-mounted guide comparable in width to the frame, slidably and adjustably affixable to a similarly sized element mounted on the supporting wall. Hirt does not teach how to initially mount the wall-supported element with a high degree of accuracy; nor does it deal with the tipping of the top of the frame away from the wall while the lower edge of the frame presumably rubs against the wall. U.S. Pat. No. 950,517, to Seidel, shows apparatus for supporting heavy objects slidably adjustable on a box-like projecting member permanently attached to the supporting wall. U.S. Pat. No. 2,508,424, to Denton, teaches the use of two long, essentially L-sectioned members, with relative vertical adjustment by threaded rods in compression, in a manner and proportion akin to those of Hirt. Devices employing hooks and threaded adjustments to support framed pictures are taught in U.S. Pat. No. 2,697,572, to Pfankuch, U.S. Pat. No. 2,522,901, to Schager et al, and U.S. Pat. No. 2,723,096 to Schwartz. Each of the last three, however, would allow the picture to fall off if severely jarred, keep the picture tipped away from the wall at the top, and allow the lower frame edge to rub on the wall.

A need, therefore, exists for a simple, inexpensive apparatus and a method for supporting a generally flat object, such as a framed picture, such that the initial aligning of the wall-attached portion is done easily with high accuracy, allowing for adjustment for levelness at any time, keeping the supported object parallel to the wall surface everywhere without rubbing of any edge against the wall, and ensuring that the object stays on the wall even when jarred violently.

DISCLOSURE OF THE INVENTION

Accordingly, it is an object of this invention to provide apparatus and a method for simply and adjustably supporting a generally flat object such as a framed picture, mirror, diploma or plaque from a vertical surface such as a wall or room divider.

It is another object of this invention to provide apparatus and a method for simply, adjustably and permanently supporting a framed object, such as a framed picture, mirror, diploma or plaque, from a vertical surface such as a wall or room divider.

It is yet another object of this invention to provide apparatus and a method for providing the types of support described above easily and very accurately, from the very start, before any adjustment capability is utilized.

It is a further object of this invention to provide apparatus and a method for providing the types of supporrt described above while maintaining the framed object parallel with the surface of the supporting wall, so that the top does not tip away from the wall and the bottom edge of the frame does not rub on the wall.

These and other related objects of this invention are achieved by attaching two multi-apertured load support brackets to the back of an object to be supported, pushing through apertures and snapping into these load support brackets bent rods with threaded upper ends, passing the threaded rod ends through apertures in wall mounted brackets, threading on screwable adjusters onto the threaded rods and turning them to align the object as desired. At least one resilient snubber is attached to the back of the supported object to ensure even spacing thereof with respect to the wall without damage to the wall surface. Temporary, preferably magnetic, tacks are used initially to locate the wall-mounted brackets before any fine alignment adjustments are made.

BRIEF DESCRIPTION OF THE DRAWINGS

The same numbers are used to identify like elements, or parts of elements, in each of the drawings and for purposes of reference elsewhere.

BEST MODE FOR PRACTICING THE INVENTION

The description below focuses on how the apparatus of this invention is most advantageously employed to adjustably and securely support a generally flat object such as a framed picture or a light mirror. With stronger elements to compensate for added weight, exactly the same form of the apparatus and method can be used equally well to support typically frameless objects such as a heavy mirror mounted on a solid wood backing, a large advertising sign, a grid carrying a neon-light display, a trophy plaque, or even an essentially three-dimensional object with a fairly flat back, e.g., a wall-clock. The description of the apparatus and method presented herein, therefore, must be understood to be readily applicable to a wide variety of supported objects.

Figure 1:
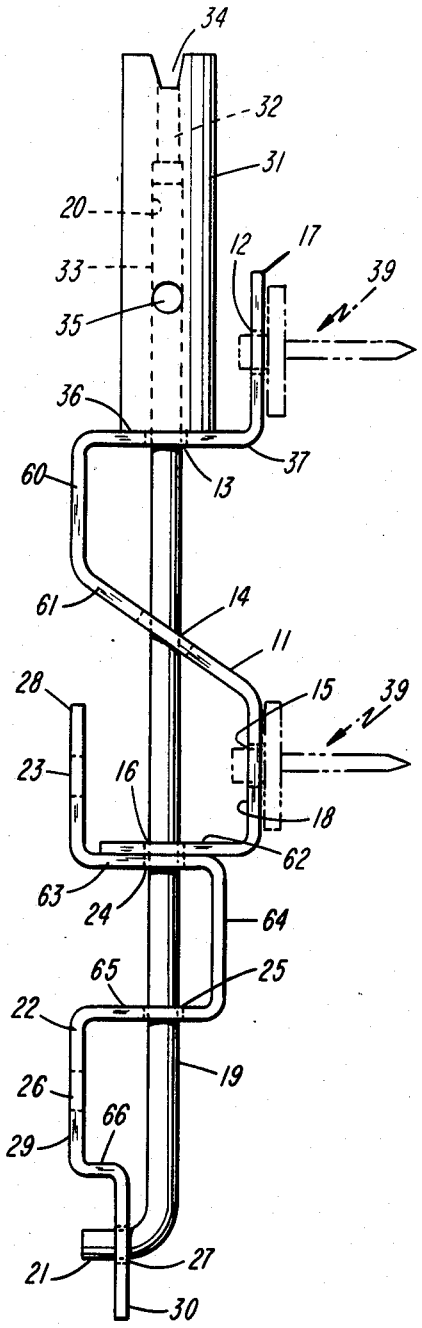
FIG. 1 is a vertical side view of the principal elements, with maximum adjustment available, indicating where magnetic locater tacks would be initially placed.
Figure 9:
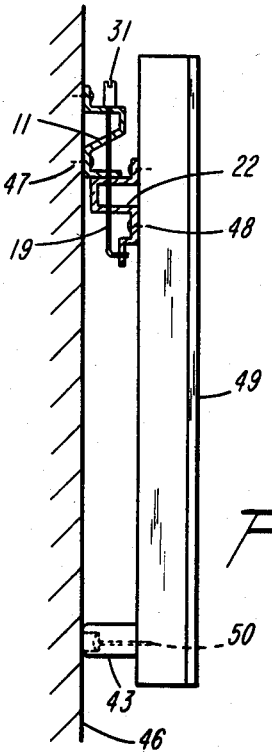
FIG. 9 is a partially sectional vertical side view of an object supported by the apparatus of this invention parallel to a vertical wall.

In FIG. 1 is shown a wall-hanger 11, preferably made of a ferromagnetic metal strip of substantially rectangular cross-section and having five holes 12–16 punched or drilled therein as shown. Holes 12 and 15, in the upper and lower vertical segments 17 and 18 respectively, are to allow firm affixation of wall hanger 11, as indicated in FIG. 9, to a wall, partition, or other load-bearing surface 46 by screws, nails, or other convenient means 47. Other affixation means for this purpose may also be employed, if more convenient or suitable, e.g., epoxy glue, contact cement, or even spot welding to a metal surface. Even with holes 12 and 15 present, surfaces 17 and 18 may be sized to have sufficient area to permit affixation, e.g., by glueing, above. Starting from the top end as depicted in FIG. 1, approximately S-shaped wall-hanger 11 comprises the following sequentially connected segments or sections: first vertical section 17, first normal section 37, third parallel section 60, inclined section 61, second vertical section 18 coplanar with first section 17, and second normal section 62.

Guide holes 13, 14 and 16 are located in wall hanger 11, in first normal section 37, inclined section 61 and second normal section 62 respectively, as depicted in FIG. 1, and are sized so as to permit non-binding positioning therethrough of a hanger rod 19 provided with a threaded top portion 20 and a short bent end 21 forming essentially a right angle at the lower end, such that end 21 is horizontal.

Immediately below the wall hanger 11, as shown in FIGS. 1 and 9, is an object hanger 22, preferably also made from the same strip material as wall hanger 11. Object hanger 22 is provided with five holes 23–27 as shown in FIG. 1. Holes 23 and 26, in the upper and lower vertical segments 28 and 29 respectively, are to allow firm affixation of the object hanger 22 to the supported object 49 by screws, nails or other convenient means 48 like those previously indicated. Guide holes 24 and 25, like 13, 14 and 16 in the wall hanger, are located and sized so as to allow non-binding positioning of hanger rod 19 therethrough. Finally, hole 27 in the lowest vertical segment 30 of object hanger 22 is a retaining hole sized so as to accommodate horizontal lower end 21 of hanger rod 19 comfortably when hanger rod 19 is snapped into place. The lateral displacement between vertical segments 29 and 30 of object hanger 22 must be selected with respect to guide holes 24 and 25, in light of the diameter of hanger rod 19 and its horizontal lower end 21 to ensure, first, that horizontal lower end 21 can be positioned in retaining hole 27 and, second, that it will not touch the back of the supported object. Starting from the top end as depicted in FIG. 1, object hanger 22 comprises the following sequentially connected segments or sections: fourth vertical section 28, third normal section 63, fifth vertical section 64, fourth normal section 65, sixth vertical section 29 coplanar with fourth vertical section 28, fifth normal section 66 and seventh vertical section 30.

Figure 2:
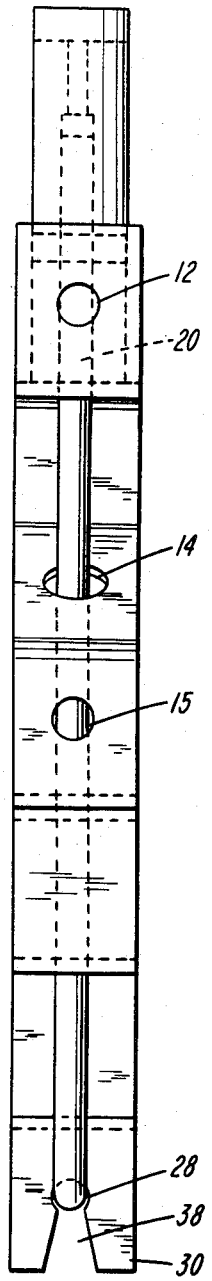
FIG. 2 is a vertical view from the wall side looking toward the back of the supported object, showing the principal elements in place with maximum adjustment available.

Cylindrically shaped height adjuster bushing 31 has a central bore 32 therethrough, the lower position 33 of which is threaded to mate with threaded portion 20 of hanger rod 19. Adjuster 31 also has a horizontal slot 34 cut in its top to allow a user to turn it by means of a screwdriver, and a horizontal view-hole 35 located laterally about one-third of the way above its flat smooth bottom 36 which rests squarely on the topmost horizontal segment 37 of wall hanger 11. As is most clearly depicted in FIG. 2, the lowest vertical segment 30 of object hanger 22 has a wedge shaped cutout 38, ending in retaining hole 27 therein, to facilitate positioning of the horizontal end 21 of hanger rod 19 thereat. It is also shown in FIG. 2 that guide hole 14, located in a sloping portion of wall hanger 11, preferably is made somewhat larger than guide hanger 13 and 16 to avoid binding hanger rod 19.

Figure 3:
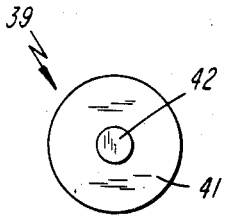
FIGS. 3 and 4 are the respective end and side view of a magnetic locater tack.
Figure 4:
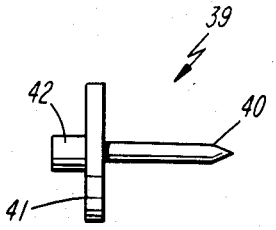
Figure 7:
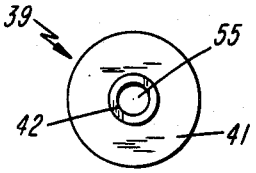
FIGS. 7 and 8 are the respective side and end views of a magnetic locater tack with an adhesive layer at one end.
Figure 8:
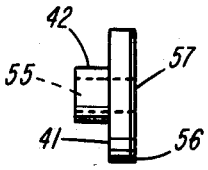

Magnetic locater tack 39, in phantom lines in FIG. 1 and clearly shown in FIGS. 3 and 4, in one form has a sharp end 40, a flat circular head 41, and a stud 42 slightly smaller in diameter than holes 12 and 15 in wall hanger 11. An alternative form of magnetic locater tack 39, with an adhesive surface instead of a sharp end, is shown in FIGS. 7 and 8. Two magnetic locater tacks 39 can be magnetically stuck to and positioned in each wall hanger 11, as indicated in FIG. 1, with studs 42 within holes 12 and 15 of the latter. Such attachment of a locater tack at each hole like 12 and 15, for reasons more fully explained below, is only temporary and may, in the alternative, be achieved by other temporary affixation means such as adhesive tape or even a drop of rubber cement. All such functional equivalents are intended to be comprehended herein. The magnetic affixation of locater tacks 39 to object hangers 11 is merely an aspect of the best mode for practicing this invention and is particularly suitable for use with iron or steel elements.

Two assemblies, each of which includes a wall hanger 11, an object hanger 22, a hanger rod 19 and a height adjuster 31, preferably should be used, one on each side of the supported object and so positioned with respect to the visible parts thereof from the front and sides as to be not noticeable in use. See FIG. 9 for depiction of a suitable positioning of such assemblies. The vertical positioning of these hanger assemblies vis-a-vis the top edge of the frame must be such as to allow easy access by means of a screw driver to slots 34 to turn the height adjusters 31 from above, as well as viewing of the view holes 35 from the sides (with the help of a small flashlight if needed to augment available local lighting). Many factors, such as the location of wooden studs within typical gypsum-board covered walls, the weight of the supported objects, and the like, are likely to influence the precise location of the hanger assemblies on a given wall. Hence, these are details best left to a user to consider in utilizing this invention under the prevailing circumstances. If only the height of the supported object is to be adjustable then a single assembly would, of course, suffice if selected to be strong enough to support the weight of the object.

Figure 5:
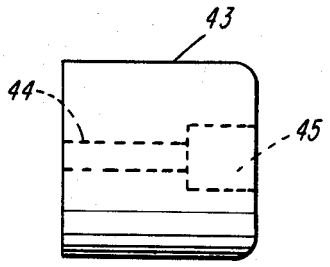
FIGS. 5 and 6 are the respective side and end views of a snubber element with a sharp pointed end.
Figure 6:
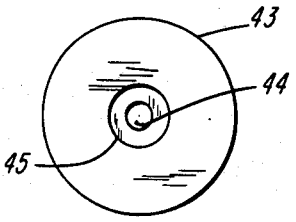

For maximum aesthetic benefit, and also to avoid rubbing of the lower back edge of the supported object on the wall surface, the hanger assemblies should be used with one or more snubbers 43, shown in FIGS. 5, 6 and 9. The snubbers are preferably made of firm but resilient material and are of a length to match the spacing between the wall surface and the adjacent surface of the supported object at the top. One snubber 43, attachable by means of a screw 50 passing through bore 44 and ending with the screwhead well within recess 45, generally centered on the lower back edge of the supported object and not readily visible from the sides, should suffice to cause most supported objects to be supported parallel to the wall surface. Furthermore, the presence of a snubber will keep the lower edge of the supported object away from the wall and, thus avoid any lateral force by the wall being exerted on the hanger assembly possibly over-stressing it. FIG. 9 indicates convenient positioning of the hanger elements and the snubber in typical use. If the supported object is horizontally long and somewhat flexible, e.g., a long canvas in a thin frame, additional snubbers may be desirable. For relatively narrow objects, a single snubber, properly positioned, should suffice. The cooperative action of the hanger assemblies and the snubber is necessary to derive the maximum benefit from this invention, although use of the hanger assemblies alone is practical and beneficial.

In practice, two object hangers 22 are attached to the back of the object to be supported, by screws through holes 23 and 26 or the like, not closer than three or four inches from each other and not too far below the top edge. If the object hangers (and hence the hanger assemblies) are placed too close together then fine adjustment to ensure verticality or levelness of the supported object may become rather sensitive and difficult. The object hangers 22 are aligned so that hanger rods 19 when in place will end up substantially vertical. Once the two object hangers 22 are firmly affixed in place, a hanger rod 19 is inserted up through holes 25 and 24 in each, and its bent lower end 21 firmly snapped into place in retaining hole 27 through suitable sized cutout 38 in each. The object can now be picked up and moved in any direction without threaded hanger rods 19 falling out of object hangers 22.

A wall hanger 11 is now slipped over the upper end of each hanger rod 19 and a height adjuster 31 fully threaded onto threaded end 20 thereof. Each hanger assembly now has full adjustment available and, by deliberate sizing of the elements, threaded end 20 of each hanger rod is located well above view hole 35 in the corresponding height adjuster 31. The alignments of the parts should conform then to that depicted in FIG. 1. The object to be supported is provided with one or more snubbers 43 as appropriate.

The user now magnetically (or otherwise) temporarily attaches the locater tacks 39 to the two wall hangers 11 at holes 12 and 15 therein, as depicted in FIG. 1, with sharp ends 40 pointed away from the back of the object to be supported, hence pointed at the wall surface when the object is held up to it in desired position. With or without the help of an assistant, the typical user can decide on a desired position of the supported object on the support surface with a fair degree of precision. The object to be supported is then pressed against the wall with only that amount of force as is required to cause sharp ends 40 of the locater tacks to penetrate into the wall surface. The points at which the tacks penetrate the wall surface thus mark the locations at which holes 12 and 15 of each wall hanger are to be centered. Holes to accommodate conventional screw housings or nails may be drilled or initiated at these locations as deemed most suitable.

When the object 49 is pulled back from supporting surface 46, depending on how penetrable surface 46 is, the magnetic locater tacks 39 may remain embedded in surface 46 at their pointed ends 40. This is most likely to occur on gypsum board or wooden supporting surfaces that can be penetrated by sharp ends 40. If such penetration is deep enough, then magnetic locater tacks 40 may be held by supporting surface 46 with a force sufficient to overcome the magnetic attraction between locater tacks 39 and the wall hangers 11.

A very useful alternative, especially suitable for hanging objects at hard and relatively rough or impenetrable supporting surfaces, e.g., a masonry or metal wall, is to have an adhesive layer 56 on the outside surface of flat circular head 41 instead of a sharp end 40 there, as illustrated in FIGS. 7 and 8. With this type of locater tack the user presses on the object, held at its selected location, firmly enough for the adhesive 56 to stick to supporting surface 46 strongly enough to stay in place as the object 49 is thereafter removed. The adhesive layer 56 can be kept covered by waxed paper 57 until the adhesive 56 is to be used to temporarily affix the locater tack 41 to the hard supporting surface 46. Such an adhesive backed magnetic tack is provided with a central hole 58 that will guide a drill bit to drill a hole at the correct location for subsequent permanent affixation of wall hanger 11 thereat by means of a screw.

The user then unthreads both height adjusters 31, removes wall hanger 11 from hanger rods 19, and affixes wall hangers 11 to the wall at the locations determined by locater tacks 39. Once wall hangers 11 are firmly affixed to the wall, the object to be supported is moved upward so that hanger rods 19 once more are located within holes 16, 14 and 13. A height adjuster 31 is now threaded onto each hanger rod 19 until the latter's end is well past view-hole 35, but not necessarily until all adjustment is taken out as will be the case when height adjuster 31 can turn no more.

The user should now step back and view the supported object to see whether any adjustment of its alignment is desirable. The height adjuster at the corner deemed highest may be unthreaded (thus lowering that corner) or, in the alternative, the height adjuster at the corner deemed lowest may be tightened up further. By careful adjustment with a simple screwdriver, this can be accomplished very swiftly. An accurate check of levelness may be made using a spirit level.

Persons skilled in the art will no doubt appreciate that the shapes of both wall hanger 11 and object hanger 22 in any hanger assembly, each having numerous bends and being made of somewhat flexible strip, allow for some give. Therefore, height adjusters 31 may be tightened up onto hanger rods 19 to an extent that causes some deformation of either or both the object hangers 22 and wall hangers 11 if desired. Tightening of the height adjusters to this extent would significantly reduce any tendency for the supported object to swing laterally away from the support, e.g., a relatively light picture near a drafty window.

The supported object should now be in place, parallel to the wall, firmly supported, correctly aligned, and securely fastened. Any subsequent adjustment necessitated by disturbance of the wall or supported object is effected, as above, by turning one or both height adjusters as appropriate. Care must be taken, by viewing view holes 35 as adjustments are being made, to ensure that the threaded end 20 of a hanger rod 19 does not fall below view hole 35. This is a simple way to guard against an inadvertent disengagement by total unthreading of a height adjuster from its hanger rod and, generally to ensure that enough threads are engaged to support a heavy object with a fair margin of safety, thus avoiding a falling of the supported object even if someone bumps into it roughly.

As the above detailed description makes clear, this invention provides apparatus and an easy method for attaching objects, e.g., framed pictures, to supporting means such as walls. The use of magnetic locater tacks virtually eliminates the need for the separate action of bothersome pre-installation measurements, typically involving the use of a folding rule or measuring tape, which almost always require several attempts of marking up of the supporting surface with pencil marks in order to correctly position an object on the wall. The disclosed method is especially beneficial and saves time if a group of objects, e.g., framed pictures, are to be positioned on the wall in some predetermined pattern.

Coupled with the above advantage is the further benefit of being able to adjust the object after it is fastened to the supporting surface so that the edges of the object are permanently level and plumb. The adjustment initially made to achieve levelness is quick, and will be permanent if the supporting surface does not undergo any significant change in form or structural condition and the load capacity of the adjustable object hanger is not exceeded.

It should be apparent from the preceding that the invention may be practiced otherwise than as specifically described and disclosed herein. Modifications may, therefore, be made to the specific embodiment disclosed here without departing from the scope of this invention and are intended to be included within the claims appended below.

What is claimed is:

1. An apparatus for adjustably and securely supporting an object having a substantially flat side from a load-bearing surface, comprising:

support means attached to said load-bearing surface for providing two fixed supports, one at each of two horizontally spaced positions on said load-bearing surface;

adjustable load transfer means, cooperating with said support means, for securely transferring therethrough the weight of said object at said supports to said load-bearing surface;

object support means, cooperating with said adjustable load transfer means, for securely transferring thereto the weight of said object, said object support means being attached to said substantially flat side of said object at locations that match said horizontally spaced positions of said supports; and adjustment means, connected to said adjustable load transfer means, for adjusting the relative vertical juxtaposition of said object support means with respect to each of said supports individually, said adjustment means having the capacity for flexibly deforming said support means and said object support means at the user's option.

2. An apparatus for adjustably and securely supporting an object having a substantially flat side from a load-bearing surface, as specified in claim 1, wherein:

each of said support means has a first aperture therein in a horizontal plane;

each of said object support means has a second aperture in a horizontal plane and a third partially segmented aperture in a lower vertical plane thereof;

each of said adjustable load transfer means has a long segment, threaded at its topmost end, and a shorter segment essentially normal to said long segment at its lower end;

each of said adjustment means has a generally cylindrical shape and an axial bore threaded to mate with said threaded topmost end of said load transfer means; and at each of said object support means said shorter segment of said load transfer means is positioned within said third partially segmented aperture while said long segment of said load transfer means passes through said second and first apertures so that said adjustment means is threaded to said topmost end thereof to adjustably and securely support said object from said load-bearing surface.

3. An apparatus for adjustably and securely supporting an object having a substantially flat side from a load-bering surface, as specified in claim 2, wherein:

each of said adjustment means is shaped at its topmost end to allow its rotation by means of a screwdriver for threading on or off said topmost end of said load transfer means threaded therein.

4. An apparatus for adjustably and securely supporting an object having a substantially flat side from a load-bearing surface, as specified in claim 3, wherein:

each of said adjustment means is provided with a lateral through aperture intersecting said threaded portion at approximately the midpoint thereof.

5. An apparatus for adjustably and securely supporting an object having a substantially flat side from a load-bearing surface, as specified in claim 1, further comprising:

locater means, attachable to a vertical surface of each of said support means in assembly with said object support means via said load transfer means and said adjuster means in fully threaded-on position, while said object support means is attached to said object but said support means is not attached to said load-bearing surface, for locating with reasonable accuracy the position at which each of said support means should be attached to said load-bearing surface.

6. An apparatus for adjustably and securely supporting an object having a substantially flat side from a load-bearing surface, as specified in claim 5, wherein:

each of said locater means has a sharp end, a flat head and a short stud.

7. An apparatus for adjustably and securely supporting an object having a substantially flat side from a load-bearing surface, as specified in claim 6, wherein:

each of said support means is magnetically attractable; and each locater means is magnetized to be temporarily attachable to said magnetically attractable support means.

8. An apparatus for adjustably and securely supporting an object having a substantially flat side from a load-bearing surface, as specified in claim 5, wherein:

each of said locater means has a flat head, a short stud with a through aperture and an adhesive coating on said flat head on the side away from said stud.

9. An apparatus for adjustably and securely supporting an object having a substantially flat side from a load-bearing surface, as specified in claim 8, wherein:

each of said support means is magnetically attractable; and each locater means is magnetized to be temporarily attachable to said magnetically attractable support means.

10. An apparatus for adjustably, securely and evenly supporting an object having a substantially flat side from a load-bearing surface, as specified in claim 2, further comprising:

snubber means attached to said substantially flat side of said object below said object support means, cooperating with said support means, for spacing said object evenly with respect to said load-bearing surface by contact therewith.

11. An apparatus for adjustably, securely and evenly supporting an object having a substantially flat side from a load-bearing surface, as specified in claim 10, wherein:

said snubber means has a resilient smooth surface where it contacts said load-bearing surface.

12. An apparatus for adjustably, securely and evenly supporting an object having a substantially flat side from a load-bearing surface, as specified in claim 1, further comprising:

snubber means attached to said substantially flat side of said object below said object support means, cooperating with said support means, for spacing said object evenly with respect to said load-bearing surface by contact therewith.

13. An apparatus for adjustably, securely and evenly supporting an object having a substantially flat side from a load-bearing surface, as specified in claim 12, wherein:

said snubber means has a resilient smooth surface where it contacts said load-bearing surface.

14. An apparatus for adjustably, securely and evenly supporting an object having a substantially flat side from a load-bearing surface, as specified in claim 5, further comprising:

snubber means attached to said substantially flat side of said object below said object support means, cooperating with said support means, for spacing said object evenly with respect to said load-bearing surface by contact therewith.

15. A method for adjustably and securely supporting an object having a substantially flat side from a load-bearing surface, comprising the steps of:

attaching object support means to said substantially flat side of said object at two positions horizontally spaced apart;

at each of said positions, through adjustable load transfer means and adjustment means, connecting said object support means to a support means in an assembly with full adjustment;

attaching temporary locater means to said support means;

holding said object at its intended position with respect to said load-bearing surface;

activating said locater means to determine proper positions for said support means on said load-bearing surface;

removing said temporary locater means, disassembling said assembly and attaching said support means individually to said load-bearing surface at said proper positions;

reassembling said assembly to support said object adjustably and securely on said load-bearing surface; and adjusting said adjustable load transfer means as and when needed to obtain desired alignment of said supported object in relation to said support means attached to said load-bearing surface.

16. A method for adjustably, securely and evenly supporting an object having a substantially flat side from a load-bearing surface as specified in claim 15, comprising the further step of:

attaching to said object, at positions below said support means, one or more snubbers to obtain even spacing of said object with respect to said load-bearing surface.

17. An apparatus for adjustably, securely and evenly supporting an object having a substantially flat side from a load-bearing surface, comprising:

approximately S-shaped support means attached to said load-bearing surface for providing two fixed supports, one at each of two predetermined horizontally spaced positions on said load-bearing surface, each of said support means being formed of an essentially flat strip having a first and a second coplanar flat sections respectively connected to a third parallel section offset therefrom by a first normal section and an inclined section, respectively, and having at one end a second normal section shorter than said first normal section, each section except said third parallel section having an aperture therein;

L-shaped adjustable load transfer means at each of said horizontally spaced positions, each having the top end of its vertical long segment threaded and its shorter segment essentially normal thereto, said long segment passing through said apertures in said first and second normal sections of said support means and said inclined section being located therebetween;

object support means attached to a generally flat surface of said object at locations to match said horizontally spaced positions and cooperating with each of said adjustable load transfer means, said object support means being formed preferably from the same material as said support means and having a fourth and a fifth coplanar flat sections, respectively, connected to a sixth parallel flat section offset therefrom by a third and a fourth normal sections, respectively, and having at one end a seventh parallel flat section offset from and between said fifth and sixth parallel flat sections, respectively, by a fifth normal section attached to said fifth parallel flat section, each of said sections except said sixth parallel and said fifth normal sections having an aperture therein, with said seventh parallel flat section having its aperture opened by a segment cut therein, and said load transfer means at each support means location passing through said apertures in said third and fourth normal segments and said segmented aperture in said seventh parallel flat section respectively; and adjustment means rotatable by a screwdriver, threaded onto the threaded top end of each of said adjustable load transfer means, for adjusting the relative juxtaposition of said object support means with respect to each of said fixed support means locations individually, each of said adjustment means being provided with a lateral through aperture intersecting the threaded portion thereof to allow viewing of said threaded portion of said adjustable load transfer means threaded therein, said adjustment means having the capacity in conjunction with said adjustable load transfer means for flexibly deforming said support means and said object support means at the user's option.

18. The apparatus of claim 17, further comprising:

snubber means attached to said substantially flat side of said object below said object support means, cooperating with said support means, for spacing said object evenly with respect to said load-bearing surface by contact therewith, each of said snubber means having a smooth resilient surface where it contacts said load-bearing surface and having at said contact end a recess and a bore to accommodate a screw or nail used to affix said snubber means to said object.

19. An apparatus for adjustably, securely and evenly supporting an object having a substantially flat side from a load-bearing surface, as specified in claim 17, further comprising:

locater means having a sharp end, a flat head and a short stud, temporarily attachable at each of said apertures in said first and second coplanar flat sections of each of said support means with said adjustment means threaded onto said adjustable load transfer means to reserve all normal adjustment therefrom, before said support means are attached to said load-bearing surface for locating, by pressure via said object held in desired position, the proper positions for attaching said support means onto said load-bearing surface.

20. An apparatus for adjustably, securely and evenly supporting an object having a substantially flat side from a load-bearing surface, as specified in claim 17, further comprising:

locater means having a flat head with an adhesive surface and a short stud with a through aperture, temporarily attachable at each of said apertures in said first and second coplanar flat sections of each of said support means with said adjustment means threaded onto said adjustable load transfer means to reserve all normal adjustment therefrom, before said support means are attached to said load-bearing surface for locating, by pressure via said object held in desired position, the proper positions for attaching said support means onto said load-bearing surface.

* * * * *